United States Patent [19]

Smith

[11] 4,033,584

[45] July 5, 1977

[54] GAME SYSTEM

[76] Inventor: Robert A. Smith, Maarland 58 N.Z., Brielle, Netherlands

[22] Filed: Mar. 17, 1975

[21] Appl. No.: 558,732

[52] U.S. Cl. ..... 273/85 A; 46/128; 46/239; 273/85 E

[51] Int. Cl.[2] ..... A63F 7/06

[58] Field of Search ..... 273/85 A, 85 B, 85 C, 273/85 D, 85 E, 85 F, 1 M; 46/128, 238, 239

[56] References Cited

UNITED STATES PATENTS

| | | | |
|---|---|---|---|
| 2,716,028 | 8/1955 | Yaeger | 273/85 B |
| 2,884,253 | 4/1959 | Rivero-Ferro | 273/85 E |

FOREIGN PATENTS OR APPLICATIONS

| | | | |
|---|---|---|---|
| 503,521 | 12/1954 | Italy | 273/85 A |
| 505,756 | 12/1954 | Italy | 273/85 A |

*Primary Examiner*—Anton O. Oechsle
*Attorney, Agent, or Firm*—William C. Norvell, Jr.

[57] ABSTRACT

A game apparatus is provided having a planar playing field and at least one player element. A horizontally rotatable disc member is provided for communication with the player element. There is a pivotable element defining a leg on the player element. Magnets are provided for the leg for activating the leg. Magnets below the disc are also provided for magnetic communication with the leg, this magnet being slidable under the disc to cause movement of the leg. The disc and the player are selectively rotatable. First and second control lines are provided for manipulation of the player in relation to the disc by a selectively activatable element, preferably a gun-like mechanism. A ball element is provided for movement on the playing field, the ball element containing a magnet. A cam arrangement is provided for arresting backward movement of the leg.

1 Claim, 7 Drawing Figures

GAME SYSTEM

BACKGROUND OF THE INVENTION

1. FIELD OF THE INVENTION

The invention pertains to a unique game system embodying, in combination, a series of activating components for causing life-like activity to the game player elements.

2. DESCRIPTION OF THE PRIOR ART

Various games are already known whereby on a board a plurality of pieces representing the player elements are disposed thereon and at the ends of the board are respective openings indicating goals. Manually operable members are arranged in such a game which are capable of moving the ball-shaped element by means of the pieces on the board in order to pass it through one of the aforementioned goal openings. Such a game has a disadvantage in that it is not life-like.

It is an object of the present invention to provide a game system which gives the impression of a real football or similar game by the life-like imitation of the movements of the players.

It is a further object of the present invention to provide a game system having therein a combination of activating elements.

Other objects and advantages will be apparent from a reading of the FIGS., the specification, and the claims below.

SUMMARY OF THE INVENTION

A magnetic game apparatus and system, preferably having at least one element and combined with a rotatable disc communicating with the player element. The disc and the player are activated by the combination of magnetic and first and second line means.

DESCRIPTION OF THE PREFERRED EMBODIMENTS

Figure 1:
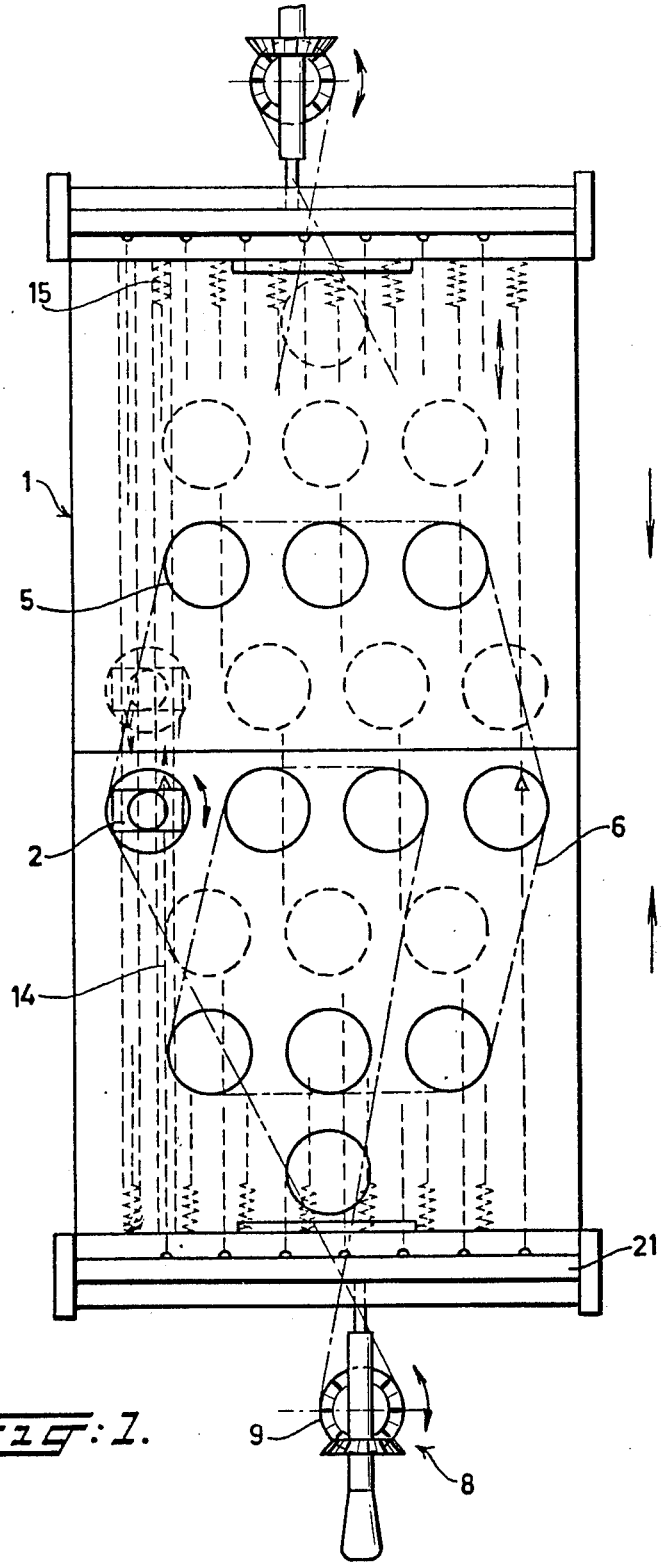
FIG. 1 shows a planar view of the game apparatus of the present invention.

In FIG. 1 is represented a carrier 1 serving as a playing field on which are the players 2. The players 2 are secured on rotating discs 3 (FIGS. 3 and 4) which are provided with a shaft 4 protruding through an opening in the carrier and on the underside thereof connected with a horizontal rope pulley 5. In the embodiment represented in FIG. 1, all players of a team are controlled by a single rope or belt 6 running in the groove 7 (FIGS. 3 and 4) provided in the rope pulleys. The movement of the rope 6 is regulated by means of the rope pulley 9 mounted in the operating member 8, the drive of the rope pulley 9 is described hereinafter with reference to FIG. 2. Under each rotatable disc 3 are two magnets 10 and 11, the hind magnet 10 exerting a force of attraction and the front magnet 11 having a repellent effect on the magnet 13 disposed the pivotal leg 12. The magnets 10 and 11 are connected with wires 14 disposed in the longitudinal direction of the field, the wires preferably being made of nylon and are on one side of the field secured by means of springs 15 and on the other side connected with a pull rod 21 which on its turn is coupled to the pull 16 of the operating member 8. When the magnets are moved, then the first magnet 10 takes along the pivotally mounted leg in a backward direction until the leg is stopped by the cam 17 (FIG. 3) likewise disposed on the rotatable disc 3, whereupon the second magnet 11 due to its repellent effect subsequently causes the leg to move fast forwardly so that a kicking movement is performed. When the ball 18 provided with magnetic material at a particular moment comes within the range of influence of magnet 11, then the ball is taken along by displacement of this magnet until the ball contacts the cam 19 and is in the "kick off" position. The cam 19 is likewise on the rotatable disc 3.

For the sake of clarity, only the rope drive system for a team is shown in FIG. 1, while obviously the array of the players can be modified at will.

Figure 2:
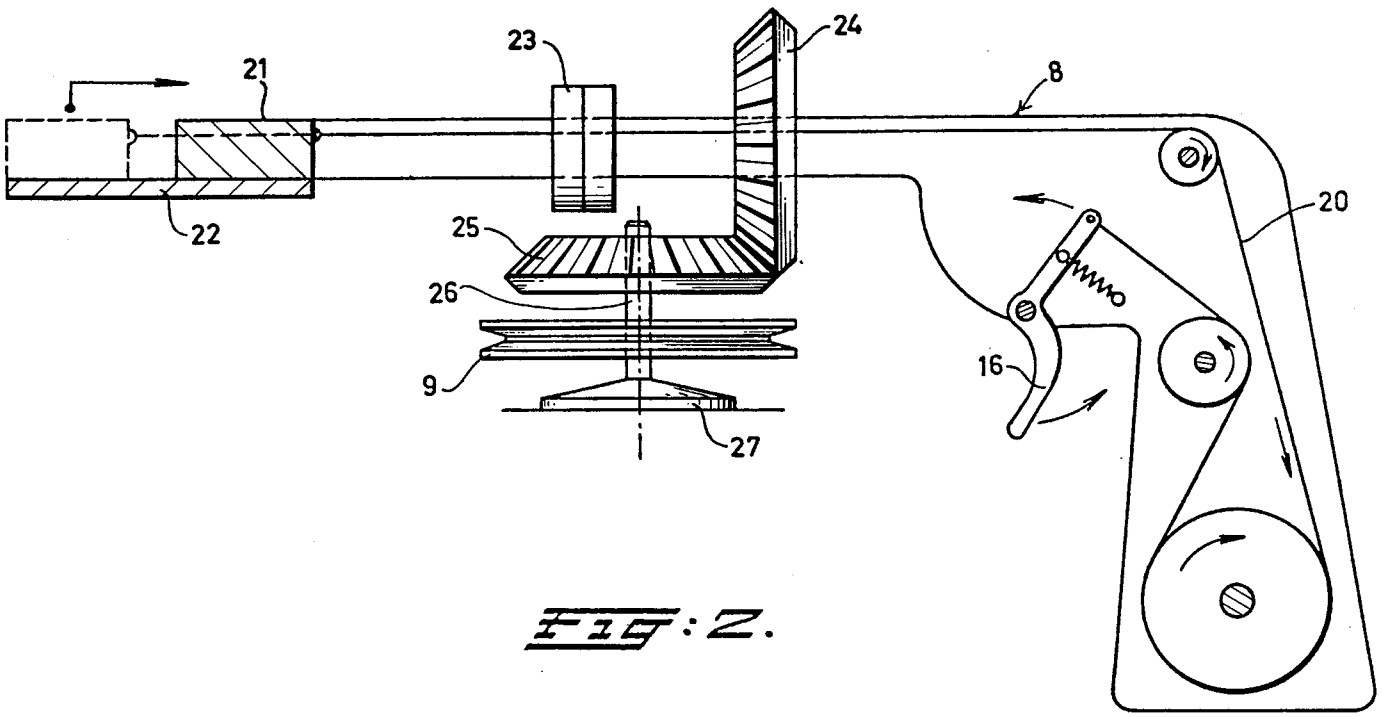
FIG. 2 is a vertical sectional drawing longitudinally depicting an operating member for the game system according to the present invention.

FIG. 2 shows a vertical longitudinal section through an operating member 8 in the shape of a pistol. The trigger 16 is connected with a rope 20 which is connected with a pull rod 21 movable in a slide 22 to which the wires 14 connected with the magnets are secured.

An operating member 8 is provided with a bearing 23 whereby the handle is rotatable in a vertical plane. Secured on the rotatable part of the operating member is a spur gear 24 which cooperates with a horizontal gear wheel 25 the shaft 26 of which is connected with the rope pulley 9 and supported in the bearing 27. By turning the stock of the pistol the rope pulley 9 is rotated, via the gearing, through a particular angle, this rotation is transferred by means of the rope 6 to the rope pulleys of the players. So by means of a single operating member, the players can be caused to perform both a rotary movement and a kicking movement.

Figure 3:
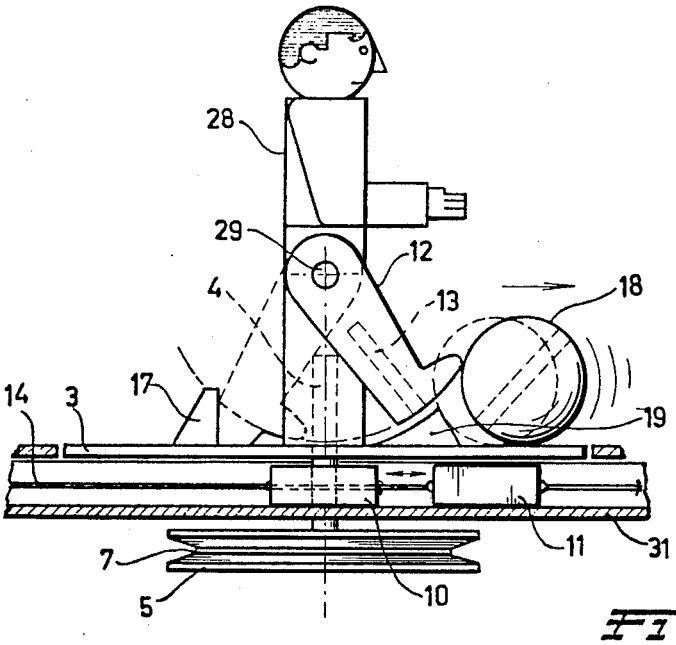
FIGS. 3 and 4 are side and front elevational views, respectively, views of a game playing figure utilized in the present game system.
Figure 4:
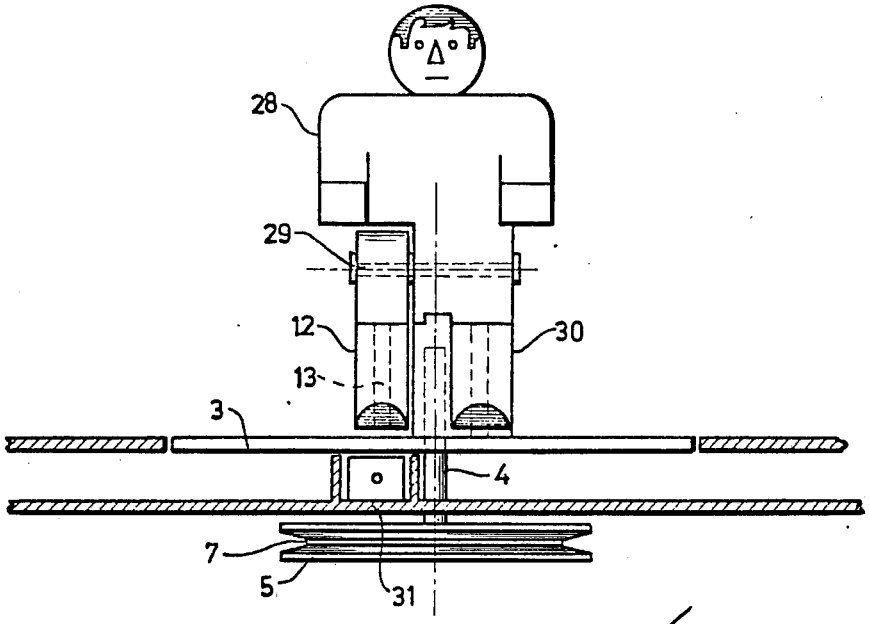

The game piece represented in the FIGS. 3 and 4 has the shape of a FIG. 28, one leg of which can turn on the shaft 29 disposed at the level of the hip, this leg containing a magnet 13. The other leg 30 is secured to the horizontal disc 3.

In the drawing, the shaft 4 of the disc 3 is on the inner side of the leg 30, but this shaft can also be accommodated in the leg 30.

Also on the disc 3 is the abutment cam 17 for the pivoted leg as well as the cam 19 for the ball 18, which allows the player element to take aim. Under the rotatable disc 3 are two magnets 10 and 11 which are glidingly movable in the slide 31 which preferably is made of any synthetic material. Instead of two magnets 10 and 11, it is also possible to use a single electromagnet which can be switched on and switched off, while the forward movement of the leg 12 is performed through any suitable spring mechanism or other means. The game figure also may be provided with more moving parts such as one or two arms which can be moved in cooperation with leg 12.

Obviously various operating members can be provided for operating individual players, whereby various performers can jointly take part in the game.

Figure 5:
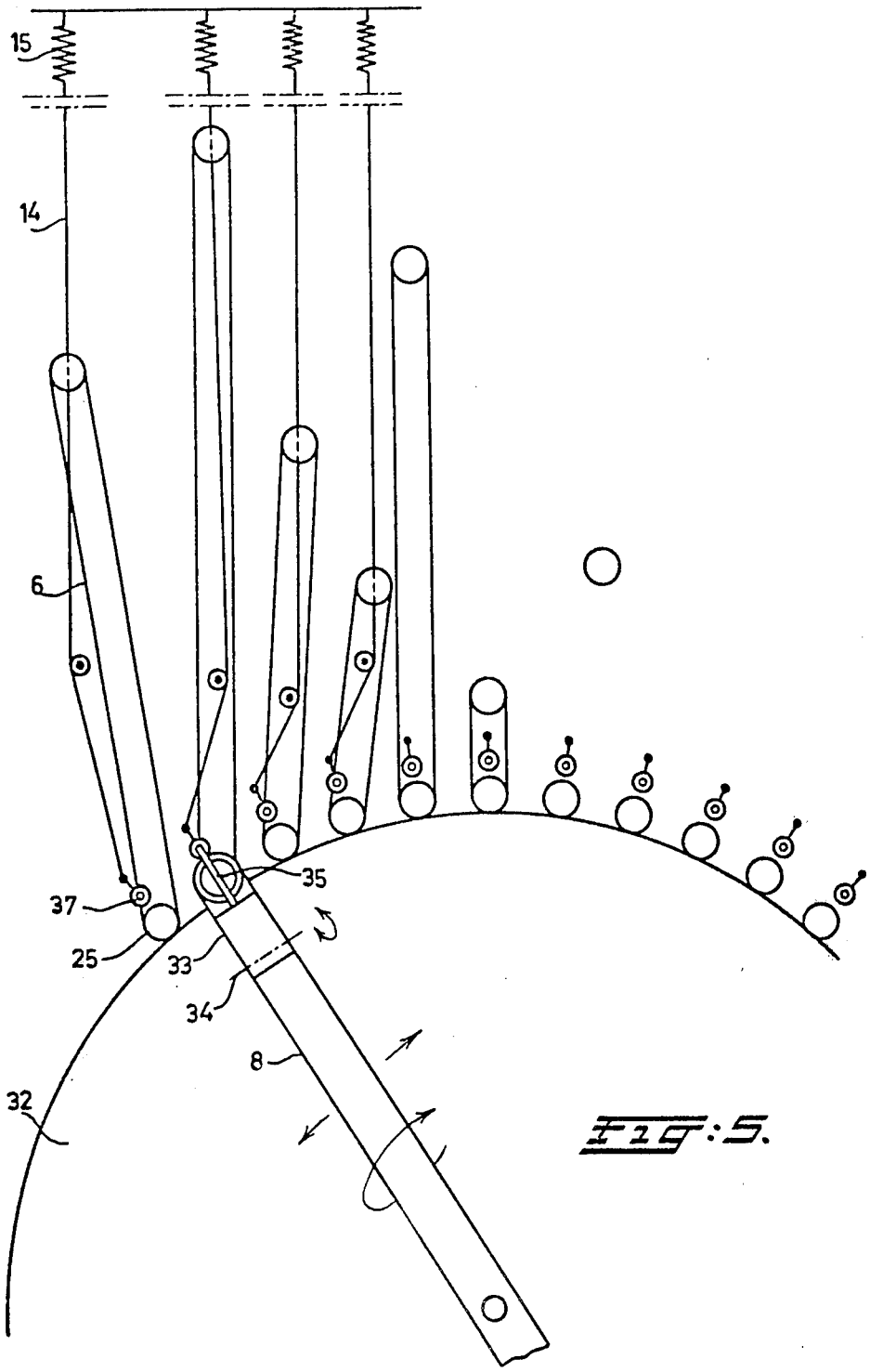
FIG. 5 is a planar view of an alternative mode of the operating or control elements of the invention.
Figures 6, 7:
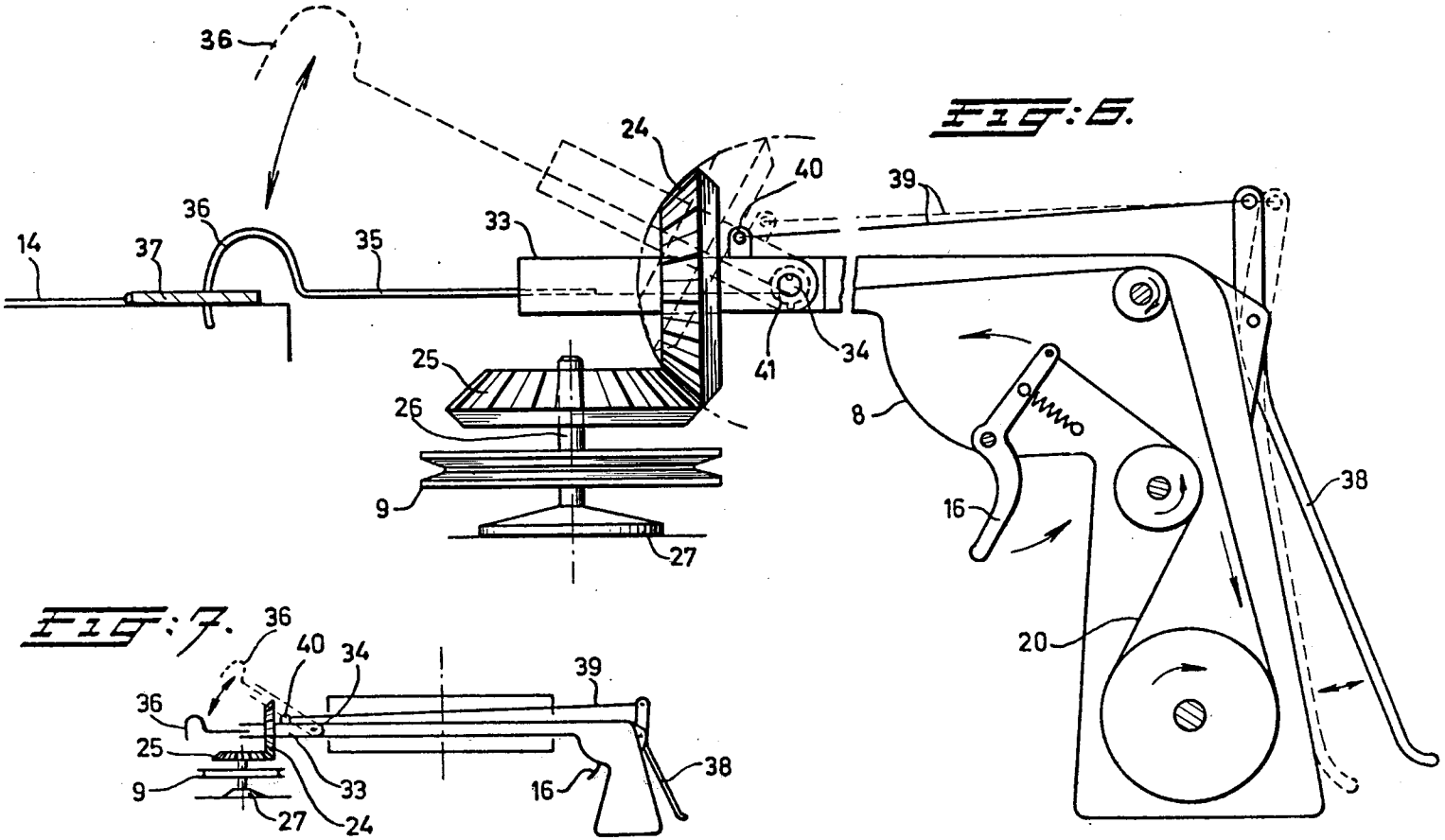
FIG. 6 is a vertical longitudinal sectional drawing of the operating element shown in FIG. 5 with an intermediate portion deleted.
FIG. 7 is a diagrammatical view of the entire operating element shown in FIG. 6.

According to another embodiment, which will be explained with reference to the FIGS. 5, 6 and 7, it is possible to control all players of a team individually by means of a single operating member. For that purpose, the operating member 8 is secured to a horizontal rotating disc 32, so that it will depict an arc. The barrel or the end 33 of the operating member to which the spur gear 24 is secured can turn on a shaft 34, the bearing 23 (FIG. 2) being in the non-pivotal part of the operating member.

At the end of a bar or pull rod 35, gliding through the barrel 33 of the operating member, is a hook 36. Provided on an arc along the circumference of the disc 32 is for each game figure a ring 37, connected with the pull wire 14 for the magnets, and a horizontal gear wheel 25 the shaft 26 of which carries a rope pulley 9, the shaft being supported in the bearing 27. Each rope pulley receives a belt or rope 6 for the rotation of the game piece concerned.

The pivotally mounted part 33 of the operating member is retained in the horizontal operating position by a torsion spring 41 mounted around the shaft 34, in which position a game figure can be controlled by means of the operating member. The operating member is provided with a suitable mechanism in order to cause the pivotally mounted part to pivot up from its horizontal position, so that the hook 36 and the spur gear 24 are released. For that purpose, a lever 38 is mounted on the stock of the operating member, while this lever is secured to a pull rod or pull wire 39 secured to a lip 40 on the pivotal part of the operating member. Obviously, any other suitable system can be used for moving upwards the pivotal part 33.

When the ball is now attracted by the magnet belonging to a particular player then the operating member with the pivotal part in the raised position can be turned in the direction of the ring 37, concerned, so that the hook 37 and the gear wheel 24 are above the ring 37 and the horizontal gear wheel 25 of the player concerned. By releasing the lever 38, the pivotal part 33 turns under the influence of the torsion spring 41 into the horizontal operating position, whereby the cooperation of hook and ring and of the two gear wheels is achieved. The game figure is subsequently controlled in the same way as described with reference to FIG. 2.

Although the invention has been described in detail, alternative embodiments will be readily apparent. Accordingly, modifications can be made without departing from the spirit or scope of the claims hereto.

What I claim and desire to be secured by Letters Patent is:

1. In a game apparatus having a planar playing field, at least one player element; a horizontally rotatable disc member communicating with said player element; at least one pivotable element on said player element defining a leg; magnetic means for said leg for contributorily activating and horizontally moving said leg; first means below said disc for complimentary magnetic communication with the magnetic means of said leg; the first means below said disc being planarly slidable thereunder to selectively cause movement of said leg; second means below and communicating with the said disc for selective rotation of said disc and said player elements; first line means for engagement with said first means below said disc to move said first means in forward and rearward directions; second line means for engagement with said second means below said disc; a selectively activatable component for movement of said first and second line means; a ball element movable along the playing field; stop means for arresting backward movement of said leg defining pivotal element; said first means comprising, in tandem alignment, a forwardmost magnetic means and a rearwardmost magnetic means, said leg magentic means being attracted to said rearwardmost magnetic means and repelled by said forwardmost magnetic means, such that as said first line means moves said first means in a rearward direction, said leg magnetic means is attracted to said rearwardmost magnetic means and said leg is pivoted rearwardly until it is arrested by said stop means, and as said first means continues in a rearward direction, said forward most magnetic means repels said leg magnetic means causing said leg to forcefully pivot forwardly to simulate a kicking of said ball element.

* * * * *